United States Patent [19]

Ljungbo

[11] 4,196,559

[45] Apr. 8, 1980

[54] SWELLABLE FABRICS FOR CEILING STRUCTURES

[76] Inventor: Sven O. B. Ljungbo, Eneby, S-190 60 Balsta, Sweden

[21] Appl. No.: 963,120

[22] Filed: Nov. 22, 1978

Related U.S. Application Data

[63] Continuation of Ser. No. 692,549, Jun. 3, 1976, abandoned, which is a continuation of Ser. No. 453,968, Mar. 22, 1974, abandoned.

[30] Foreign Application Priority Data

Mar. 28, 1973 [SE] Sweden ..... 7304368

[51] Int. Cl.[2] ..... E04G 21/00; D06M 1/02

[52] U.S. Cl. ..... 52/741; 8/125

[58] Field of Search ..... 8/125, 127; 428/264, 428/274, 393; 52/741, 746; 156/85

[56] References Cited

U.S. PATENT DOCUMENTS

| | | | |
|---|---|---|---|
| 1,885,345 | 11/1932 | Guthrie | 156/85 |
| 2,112,499 | 3/1938 | Lilienfeld | 8/20 |
| 2,867,547 | 1/1959 | Dock Fon Toy et al. | 428/264 |
| 3,037,868 | 6/1962 | Rosser | 156/85 |
| 3,090,666 | 5/1963 | Jones | 8/125 |
| 3,285,690 | 11/1966 | Cooper et al. | 8/116.3 |
| 3,526,540 | 9/1970 | Lindemann et al. | 428/264 |
| 3,560,139 | 2/1971 | Suminwokura et al. | 8/125 |
| 3,615,966 | 10/1971 | Ljungbo | 156/85 |
| 3,822,994 | 7/1974 | Boer et al. | 8/125 |
| 3,873,504 | 3/1975 | Boettcher et al. | 428/393 |
| 3,874,912 | 4/1975 | Swidler et al. | 428/264 |
| 3,955,032 | 5/1976 | Mischutin | 428/275 |

*Primary Examiner*—John E. Murtagh

*Attorney, Agent, or Firm*—Burns, Doane, Swecker & Mathis

[57] ABSTRACT

The invention relates to a swellable surface product such as paper, fabric, tricot, non-woven fabric and the like for setting up self-stretching ceiling structures, wall coverings and the like. Said surface product comprises essentially cellulose fibres having a lower, preferably at least 5% lower crystallinity level than the crystallinity level of native cellulose (Cellulose 1), said fibres having good swellability in water, for instance, both in their longitudinal and their transverse direction.

2 Claims, No Drawings

SWELLABLE FABRICS FOR CEILING STRUCTURES

This is a continuation of application Ser. No. 692,549, filed June 3, 1976 now abandoned which is a continuation of application Ser. No. 453,968 filed Mar. 22, 1974, now abandoned.

The technique of setting up suspended ceilings in houses has been further developed in several ways the last few years. The oldest technique comprised manually setting up a fabric made of, for example, jute, cotton or some other cellulose fibre and, thereafter, painting the same, normally with white paint. Said method has been improved by means of exchanging the fabric for an elastic plastics sheeting (film) which is easier to set up and which better endures any settling of the house or building. The plastics sheeting does not have to be painted as it already has a white, compact surface. A further improvement comprises swelling these sheetings with a swelling agent before said sheeting is set up, after which the swelling agent is allowed to evaporate, whereby the sheeting shrinks and is stretched by itself. By mixing in glass fibres or other non-flammable fibres in the plastics sheeting, said sheeting will not collapse in the event of fire. Despite the inclusion of rigid, non-swellable fibres, the sheeting will maintain its ability to swell or expand in a solvent and then shrink to total stretching when the solvent has evaporated after the ceiling structure has been installed or set up.

Several attempts have been made to, in a corresponding manner, stretch for example jute or cotton fibres after they have been swelled in water. However, all of these attempts have failed due to the fact that the threads in said fibres, as in all natural cellulose fibres, have an extremely insignificant longitudinal swelling while the transverse swelling of said threads is, on the other hand, considerable. That is, the swelling in the direction of the surface of the fabric, which is a pre-condition for the use of the method in setting up ceiling structures, has not yet been obtained.

It has now been found that cellulose fibre fabrics can be produced with the desired swellability in the surface of said fabrics. The low longitudinal swelling of fibres of natural or native cellulose has namely shown itself to be connected with its high crystallinity level and, to some extent, with the type of crystal; a characteristic trait for native cellulose, also called Cellulose I.

If fabrics or cellulose fibres are produced whose crystallinity level has been reduced and whose share of amorphous material has, therewith, been increased in relation to the native cellulose from which they have been produced, said fabrics should be able to be swelled in water so that they are enlarged considerably (more than 10%) surface-wise. Such a swelled fabric can be used in the same way as the previously mentioned plastics sheetings in order to set up a ceiling in a room, said fabric stretching itself by means of shrinking when the water (swelling agent) evaporated.

The most common methods of reducing the crystallinity level of cellulose comprise treating said cellulose with strong alkalies or other strong electrolytes in an aqueous solution or with liquid ammonia, amines or quaternary ammonium compounds and then washing the reagents away or dissolving the cellulose and spinning fibres of the same, for example, according to the viscose or copper ammonium method or by regenerating the cellulose from fibres of cellulose derivative, for example acetate cellulose, nitrocellulose etc.

Other methods comprise partially substituting the hydroxyl groups of the cellulose with, for example, methyl-, ethyl-, hydroxyethyl-, hydroxypropyl, carboxymethyl-aminoethyl-amidoacryl groups etc.

In the majority of these methods, the crystal structure of the cellulose changes as well as its crystallinity level and said cellulose changes into a form which is normally called Cellulose II.

The difference between the crystal structure of Cellulose I and Cellulose II chiefly lies in that one crystal axis in the elementary cell is extended in Cellulose II and that the angle between two crystal axes is simultaneously reduced. Different authors disclose different values which have been compiled, in the following mean values, by Treiber in his book "Die Chemie der Pflanzenzellwand", page 157 (Berlin 1957):

| | Angström length in the Axes | | | Angle between | |
|---|---|---|---|---|---|
| | a | b | c | a and b | |
| Cellulose I | 8.20 | 10.29 | 7.83 | 84° | 23' |
| Cellulose II | 8.25 | 10.3 | 9.25 | 61° | 13' |

The elementary cell in Cellulose II is somewhat "more loosely packed" than in Cellulose I and, thus, should be somewhat more responsive when it comes to swelling.

The crystallinity level, which is disclosed in percent crystalline material based on the total amount of cellulose in the fibres, varies in different cellulose material. Different measuring methods also provide different results, as can be seen by the following tables.

In "Textile Research Journal", 17, 585 (1947), Philipp, Nelson and Zufle disclose the following values for crystallinity in various cellulose materials, measured by acidic hydrolysis:

| Material | Crystallinity 2 |
|---|---|
| Ramie | 95 |
| Cotton | 82–87 |
| Cotton linters | 88 |
| Cotton, mercerized during stretching | 78 |
| Cotton, mercerized without stretching | 68 |
| Fortisan ® (saponified acetate cellulose fibre) | 83 |
| Cordura ® highly durable rayon | 62 |
| Textile rayon | 68 |

In "Journal Polymer Sci." 4, 135 (1949); 5, 656 (1950); 6, 533 (1951), P. H. Hermans and A. Weidinger disclose the following values for crystallinity in cellulose fibres, measured partly from Roentgen diagram and partly by means of tightness determinants:

| Material | From the Roentgen diagram | From tightness det. |
|---|---|---|
| Cotton | 70 | 60 |
| Ramie | 70 | 60 |
| Sulfite cellulose | 65 | 50 |
| Fortisan ® | 50 | — |
| Viscose rayon | 40 | 25 |

It has now been found that in order to obtain sufficient longitudinal swelling of the cellulose threads and filaments that are to be used for swellable, self-stretching ceiling structures, some type of cellulose fibre treated according to the above should be used, the crystallinity of which is more than 5% lower than the crystallinity of the native cellulose from which said cellulose fibres are produced.

In order to obtain a great surface swelling of the fabrics it has also been found essential to maintain a low or moderate level of orientation of the cellulose fibres which are used.

This orientation is achieved, both in mercerizing cellulose fibres as well as in spinning dissolved cellulose, by means of the fibres being stretched during the process. Said stretching should be avoided or kept moderate during the production of fibres for the present purpose.

In order to obtain special effects, for example with regard to burning properties, the cellulose fibres can be mixed with fibres of another material, for example mineral fibres. This can be carried out either during spinning so that a yarn of mixed fibres is spun, or during weaving whereby threads of different fibre material are used in the same fabric.

Before or after the weaving, the fibre material should be treated with flame-inhibiting material which results in that the fabric cannot burn but, rather, can only carbonize if it is subjected to fire. Examples of such fire-inhibiting materials are phosphates, phosphites, phosphonium compounds, borates, bromine- or chlorine compounds, antimony compounds, etc.

The fabrics could also be lined with different plastics in the form of solutions, emulsions or sheeting in order to provide the product with, for example, a more compact surface, better flame-resistance or other desired properties. These plastics should be swellable in water so that the plastics coating or layer swells along with the fabric when the sheet (of fabric) swells as a whole.

The following examples show some embodiments of the method according to the invention.

EXAMPLE 1

A cotton fabric is immersed for 5 minutes in a 3% solution of sodium hydroxide in water, said solution having been heated to a temperature of 85° C. Said fabric is subsequently immersed for 1 minute in a 20% solution of sodium hydroxide in water, said solution having been heated to a temperature of 25° C., whereupon it is immediately freed from all lye (liquor) by means of rinsing with water. During the entire process, the sheet (of fabric) should not be stretched more than is necessary for its conveyance through the baths.

After further thorough washing out of all the remaining lye, the fabric is impregnated with a solution of ten parts diammoniumorthophosphate and 30 parts carbamide in 60 parts water. When the excess solution has been pressed out, the fabric is dried for 13 minutes at a temperature of 160° C., after which it is washed in water and dried. This anti-flame treatment results in that, in the event of fire, the fabric cannot sustein combustion but, rather, is only carbonized into a carbon shell which is difficult to make into ash. The fabric is sewn together in sections of a suitable size of a ceiling structure. This sewing together is carried out with cotton thread which has been anti-flame treated in a manner similar to the one described above or with glass fibre thread. The fabric is, thereafter, swelled in water and set up on the walls at a suitable height under the existing ceiling in the room in which the fabric shall serve as a ceiling structure. It is not necessary to herewith stretch the fabric but, rather, it may hang loosely like a sack. As the water evaporates, the fabric will shrink and, thus, stretch itself.

This fabric can also be coated with plastics in order to obtain a more fire-resistant product. The following example shows an embodiment thereof;

EXAMPLE 2

A fabric according to Example 1 is coated on one side with the following paste:

8 parts ethylhydroxyethyl cellulose
7 parts triethanolamin
4 parts triaminotriazine
5 parts pentaerythrite
7 parts ammoniumpolyphosphate
3 parts titanium dioxide
0.5 part oxaldehyde
2.5 parts formic acid
63 parts water The coated surface is strewn with 3 cm long glass threads or filaments to a weight of 20 grams/m$^2$ and subsequently dried in an oven at 100° C. After said drying, the fabric is once again coated on the same side with the same paste and, once again, dried in the same manner.

The resulting fabric sheet is cut into pieces of a suitable size, moistened in water until maximum swelling has been obtained and then set up as a ceiling structure in the same manner as disclosed in Example 1.

The coating, which has been applied onto the fabric, has the property of providing a powerful carbon foam in the event of fire, said carbon foam being very difficult to make into ash. This carbon foam functions as heat insulation and, thus, protects the portions of the building which are situated above the fabric ceiling from such an extreme heat that said portions should ignite.

The ethylhydroxyethyl cellulose, by means of the reaction with oxaldehyde, has converted into a water-insoluble form but is still swellable in water. Thus, the ceiling can be washed after it has been set up, if this should be necessary.

EXAMPLE 3

Staple fibres are produced from viscose cellulose with the help of an insignificant stretching during spinning. 95 parts of these fibres are mixed with 5 parts aluminum silicate fibres having a fibre diameter of 2.5μ and are carded and spun to a yarn having coarseness number 30. A fabric is woven from the yarn having 10 threads/cm in each warp and weft. The fabric is anti-flame treated with ammonium phosphate and carbamide in the same manner as disclosed in Example 1 and can then be used as a ceiling in the same way as disclosed in Example 1. It is also possible to coat the same with a plastics mass according to Example 2. It is not necessary to strew the fabric with glass threads as the aluminum silicate threads, which are already spun into the yarn, provide sufficient bearing resistance for the fabric in the event of fire so that said fabric shall form a continuous carbon foam-mineral fabre matting.

EXAMPLE 4

A 400 deniers viscose silk thread, which has been produced with insignificant stretching during spinning, is woven together with an equally coarse glass fibre thread into a fabric having 10 threads/cm in each warp and weft direction. The glass threads constitute each tenth thread in both the warp direction as well as the waft direction. The fabric is anti-flame treated with ammonium phosphate and carbamide in the same manner as disclosed in Example 1, after which it is ready to be used as a swellable ceiling structure. The fabric can also be coated with plastic mass in the same manner as disclosed in Example 3 for use as combustion-protective ceiling. As the shrinking is greater than the swelling, these glass fibre threads, which do not participate either in the shrinking or the swelling, do not prevent the use of the fabric as a self-stretching ceiling. Naturally, the shrinking effect can be increased in these threads by means of moistening the viscose silk threads prior to weaving of the same. During shrinkage, the glass threads provide the setting up of the ceiling structure with a certain crimping effect which can be used for decorative purposes.

EXAMPLE 5

A tricot web is produced from the thread which has been produced according to Example 3. The tricot web is then anti-flame treated according to Example 3, after which the fabric is coated with a plastics mass in the same manner as disclosed in Example 3.

The tricot web has the advantage over the woven fabric in that, when it comes to complicated room shapes, it is less likely to give rise to wrinkles or drafts in the surface of the fabric when the web begins to stretch itself (shrink).

The tricot web can also be knitted from viscose silk thread which has been produced according to Example 4. However, one should, therewith, replace a portion of the silk threads with glass fibre threads resulting in that certain threads in the tricot web are composed of glass fibre. The tricot web is subsequently coated with a plastics mass in the same manner as disclosed in Example 3.

EXAMPLE 6

Cotton is treated with a solution of 2-aminoethylsulphuric acid and sodium hydroxide in water and is heated so that an aminoethyl cellulose is obtained, said cellulose having a substitution level of approximately 1.2. The washed product from the reaction solution is subsequently treated with tetrakishydroxymethylphosphonium chloride and ammonia in an aqueous solution and is then washed and dried. The resulting fibre is mixed with approximately 5% glass fibre having a staple length of 2 cm and a diameter of 5μ and is then carded out. The resulting non-woven fibre is glued in a dotted pattern by means of melamine glue and is then dried and hardened at an oven temperature of 105° C.

The resulting product, which is of the non-woven fabric type, can, after swelling in water, be used for setting up a ceiling structure in the same manner as disclosed in the previous example.

EXAMPLE 7

Bleached sulphate cellulose from pine is aminoethylated and phosphonium-treated in the same manner as the cotton in the previous example. A sheet of paper is produced from the resulting fibre, said paper sheet having a gram weight of 50 g/m$^2$. Twisted rayon threads (3 cm long, 840 deniers coarseness) are strewn onto the wet sheet, said rayon threads being produced in the same manner as disclosed in Example 4. The rayon threads are anti-flame treated by means of aminoethylation and phosphonium treating and are dressed with polyethylenimine which is treated with tetrakishydroxymethylphosphonium chloride, and glass fibre threads of the same length and denier count, spun from glass fibres having 5μ diameter and dressed or finished in the same manner as the rayon threads, whereby the mixing ratio between the rayon and glass threads is 3:1. The thread layer has a weight of 75 g/m$^2$.

A further suspension of the above-described aminoethylated and phosphonium-treated cellulose fibre is poured on top of the rayon and glass thread layer so that said layer, together with the suspension, and the first sheet form a paper having a gram weight of 175 g/m$^2$. This sheet is impregnated with a solution of ethyletoxy cellulose and oxaldehyde in water, pressed off and dried. The resulting sheet can be used as a ceiling structure in the same manner as in the previous examples.

The sheet can also be coated with a mass of the same kind as in Example 2 and the formed product can be used as a ceiling structure according to the above.

What I claim is:

1. A method of erecting ceiling structures and wall coverings which comprises swelling with an aqueous liquid a tricot fabric which is lined with a water swellable plastic material, said fabric consisting substantially of cellulose II fibers, securing the swelled lined fabric in position via its margins as a ceiling structure or wall covering, and drying the hung lined fabric in situ by the evaporation of said aqueous liquid, said lined fabric stretching itself by means of shrinking as the water evaporates.

2. The method of claim 1 wherein the cellulose II fibers are made from viscose cellulose and are produced by spinning without any significant stretching thereof.

* * * * *